US010323894B2

(12) United States Patent
Imbriano et al.

(10) Patent No.: US 10,323,894 B2
(45) Date of Patent: Jun. 18, 2019

(54) WEAPONS SYSTEM SMART DEVICE

(71) Applicants: Paul Imbriano, Rowley, MA (US); Christopher Michael White, Peabody, MA (US)

(72) Inventors: Paul Imbriano, Rowley, MA (US); Christopher Michael White, Peabody, MA (US)

( * ) Notice: Subject to any disclaimer, the term of this patent is extended or adjusted under 35 U.S.C. 154(b) by 0 days.

(21) Appl. No.: 15/241,763

(22) Filed: Aug. 19, 2016

(65) Prior Publication Data

US 2017/0051993 A1 Feb. 23, 2017

Related U.S. Application Data

(60) Provisional application No. 62/206,949, filed on Aug. 19, 2015.

(51) Int. Cl.
*F41A 19/01* (2006.01)
*F41A 9/65* (2006.01)
*F41A 9/62* (2006.01)

(52) U.S. Cl.
CPC ..... *F41A 19/01* (2013.01); *F41A 9/62* (2013.01); *F41A 9/65* (2013.01)

(58) Field of Classification Search
CPC ..... F41A 9/53; F41A 9/62; F41A 19/01
USPC ..... 42/1.01–1.05
See application file for complete search history.

(56) References Cited

U.S. PATENT DOCUMENTS 4,001,961 A * 1/1977 Johnson ..... F41A 19/01 324/94
5,052,138 A * 10/1991 Crain ..... F41A 9/62 42/1.02
5,303,495 A * 4/1994 Harthcock ..... F41A 9/62 42/1.02
6,094,850 A * 8/2000 Villani ..... F41A 9/62 42/1.02
6,415,542 B1 * 7/2002 Bates ..... F41A 17/06 42/70.05
7,509,766 B2 * 3/2009 Vasquez ..... F41A 19/01 42/1.01
8,046,946 B2 * 11/2011 Packer ..... F41A 19/01 324/200
8,176,667 B2 * 5/2012 Kamal ..... F41A 19/01 42/1.01

(Continued)

FOREIGN PATENT DOCUMENTS

WO WO 2017/031426 2/2017

OTHER PUBLICATIONS

International Search Report and Written Opinion in PCT application PCT/US2016/047774 dated Oct. 28, 2016 (12 pages).
International Preliminary Report on Patentability in PCT application PCT/US2016/047774 dated Mar. 1, 2019 (8 pages).

*Primary Examiner* — Stephen Johnson
*Assistant Examiner* — Benjamin S Gomberg
(74) *Attorney, Agent, or Firm* — Fish & Richardson P.C.

(57) ABSTRACT

A weapons system comprises a firearm, one or more sensors on an interior or exterior portion of the firearm configured to detect a motion or location of a moving part of the firearm relative to the sensor, a microprocessor configured to detect a signal sent by the one or more sensors and determine a status of the firearm, and a display in communication with the microprocessor configured to display information relating to the status of the firearm.

18 Claims, 7 Drawing Sheets

(56) References Cited

U.S. PATENT DOCUMENTS 8,223,019 B2 * 7/2012 August ..... F41A 17/063 340/572.1
8,339,257 B2 * 12/2012 Cazanas ..... F41A 19/01 340/539.1
8,418,388 B2 * 4/2013 Ferrarini ..... F41A 19/01 42/1.03
8,464,451 B2 * 6/2013 McRae ..... F41A 17/06 42/1.01
8,726,556 B1 5/2014 Willingham
8,733,006 B2 * 5/2014 Williams ..... F41A 17/063 42/1.01
8,826,575 B2 * 9/2014 Ufer ..... F41A 19/01 42/1.01
8,973,294 B2 * 3/2015 Delgado Acarreta ..... F41A 9/62 42/1.02
9,032,656 B2 * 5/2015 Lupher ..... F41A 19/58 42/1.01
9,273,918 B2 * 3/2016 Amit ..... F41A 19/01
9,612,068 B2 * 4/2017 Burden ..... F41A 9/62
2006/0005447 A1 * 1/2006 Lenner ..... F41G 3/06 42/111
2007/0000483 A1 * 1/2007 Tsurumoto ..... F41A 17/36 124/73
2008/0289485 A1 11/2008 Quinn et al.
2011/0030257 A1 2/2011 Gwillim, Jr.
2011/0185617 A1 8/2011 Brixius
2011/0252682 A1 * 10/2011 Delgado Acarreta ..... F41A 9/62 42/1.02
2012/0167423 A1 * 7/2012 Kindt ..... F41A 9/62 42/1.02
2014/0311003 A1 * 10/2014 Loreman ..... F41A 9/62 42/1.02
2014/0378088 A1 * 12/2014 Goel ..... F41A 17/063 455/404.2
2015/0219425 A1 * 8/2015 Beckman ..... F41H 11/00 89/1.11
2016/0033221 A1 * 2/2016 Schmehl ..... F41A 33/00 42/90

* cited by examiner

WEAPONS SYSTEM SMART DEVICE

CLAIM OF PRIORITY

This application claims priority under 35 USC § 119(e) to U.S. Patent Application Ser. No. 62/206,949, filed Aug. 19, 2015, the entire contents of which are hereby incorporated by reference.

TECHNICAL FIELD

This invention relates to weapons systems.

BACKGROUND

One of the biggest concerns of personnel in use of a firearm is its overall functionality. From how many bullets are left in the magazine to the reliable functioning of the weapon, the monitoring or lack thereof of the system can result in death, injury, or lack of confidence on the battlefield.

SUMMARY

The proposed device is intended to keep track of data in a weapons system such as how many shots have been taken so as to help the user know when one should reload their weapon and the location and orientation of another friendly weapon. This disclosure includes a system that provides data on the various functions of a weapon system including but not limited to the counting of ammunition and the overall status and condition of the weapon system. Any type of display can be used to show, for example, an increment to a counter, a decrement from a smart magazine or other devices, or other data such as an accelerometer and magnetometer to make up an inertial navigation system (INS), or a global positioning system (GPS) module, heart or pulse monitor or other biological sensor.

Advantages include that the user of the system of this disclosure has improved confidence in the reliability of their weapon system.

A weapons system smart device comprises a sensor on an interior or exterior portion of a firearm or weapon system configured to detect the motion of a moving part of the firearm relative to the sensor and a microprocessor configured to detect a signal sent by the sensor. The microprocessor can also increment a counter. Additional sensors such as GPS and INS sensors send data to the microprocessor regarding the weapon's heading and location. In some embodiments, the weapons system smart device comprises a display configured to show the counter or other data such as latitude and longitude and direction with respect to the North Pole. The moving part of the firearm is a bolt carrier group or component in a magazine. A magnet is placed on the moving part of the firearm or weapon system that triggers the sensor when the magnet and sensor are in proximity. The microprocessor collects data from GPS or INS sensors and transmits this data to other devices.

In one aspect, a weapons system includes a firearm, one or more sensors on an interior or exterior portion of the firearm configured to detect a motion or location of a moving part of the firearm relative to the sensor, a microprocessor configured to detect a signal sent by the one or more sensors and determine a status of the firearm, and a display in communication with the microprocessor configured to display information relating to the status of the firearm.

Implementations may include any or all of the following features. The microprocessor is configured to increment a counter. The counter represents a number of instances the firearm has been discharged. The one or more sensors includes a Hall effect sensor. The one or more sensors includes a reed switch. The system for includes a global positioning system or an inertial navigation system to track the location or motion of the firearm. The moving part of the firearm is a bolt carrier, and the microprocessor determines that a signal sent from the one or more sensors represents the discharging of an ammunition round and shell casing from the firearm. The moving part of the firearm is a follower that moves in a magazine of the firearm as ammunition rounds are added to or removed from the magazine, the one or more sensors are coupled to the magazine and detect a position of the follower. At least one of the one or more sensors comprises multiple portions coupled to the magazine and a single portion coupled to the follower that aligns with one of the portions of the sensors coupled to the magazine. The microprocessor detects a position of the follower within the magazine and determines a number ammunition rounds present in the magazine. The microprocessor is configured to determine a number of ammunition rounds remaining in a magazine residing in the firearm. The display is configured to show a number of instances the firearm has been discharged. The display is configured to present a location and a heading of the firearm. The display is configured to present an alert when an undesired location and heading is detected. The display is part of a smart phone or tablet located external to the firearm. The display is attachable to the firearm. The moving part of the firearm is a bolt carrier group. A magnet is located on the moving part of the firearm that triggers the sensor when the magnet and sensor are in proximity.

In another aspect, a device for use with a firearm includes a computing device for receiving signals representative of a location or movement of a moving part of a firearm during discharge of an ammunition round, and the computing device is configured to determine a count of a number of instances that the firearm has been discharged from the received signals and to communicate the determined count to a display.

Implementations may include any or all of the following features. The display is part of a smart phone or tablet located external to the firearm. The display is attached to the firearm. The computing device receives the signals from one or more sensors attached to the firearm.

In another aspect, a computing device-implemented method includes receiving signals representative of a location or movement of a moving part of a firearm during discharge of an ammunition round, producing a count of a number of instances that the firearm has been discharged from the received signals, and presenting the determined count on a display of the firearm.

In another aspect, one or more computer readable media storing instructions that are executable by a processing device, and upon such execution cause the processing device to perform operations including receiving signals representative of a location or movement of a moving part of a firearm during discharge of an ammunition round, producing a count of a number of instances that the firearm has been discharged from the received signals, and presenting the determined count on a display of the firearm.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

This disclosure includes a system that provides data on the various functions of a weapon system including but not limited to the counting of ammunition, the location, the heading, and the overall status and condition of the weapon system. This disclosure employs the use of magnetic fields along with the internal movement of parts either on or separate from the weapon to produce data on the functions and status of a weapon system. The general concepts of this system include magnetism being used on the internal parts of the firearm or weapon system and being detected by a system of discrete circuitry which can be interpreted by the user or overseer. This system uses metallic, composite, and other elements found in the periodic table to function. It may use iron, steel, aluminum, lead, copper, and/or tin, as well as other metals as part of the function. It can use an earth magnet, electromagnet, or any type of material that holds a charge. Plastics and/or fibers and synthetics can be used as well.

This disclosure can allow the user or overseer of the weapon system to account for things including but not limited to ammunition count, temperature, and correct function of the weapon system, orientation of weapon system, and overall use and status. A device such as a camera can also be used on the system for night vision, thermal vision, heat sensing, radiation detection, object recognition, visual magnification, windage adjustments, wireless and wired connectivity, GPS, and dead reckoning. The disclosure can be powered by battery, PV, Seebeck effect, biological, thermal, environmental energies, or other energy source. Internally the system may provide power to other components by an electromagnetic field.

Figure 1:
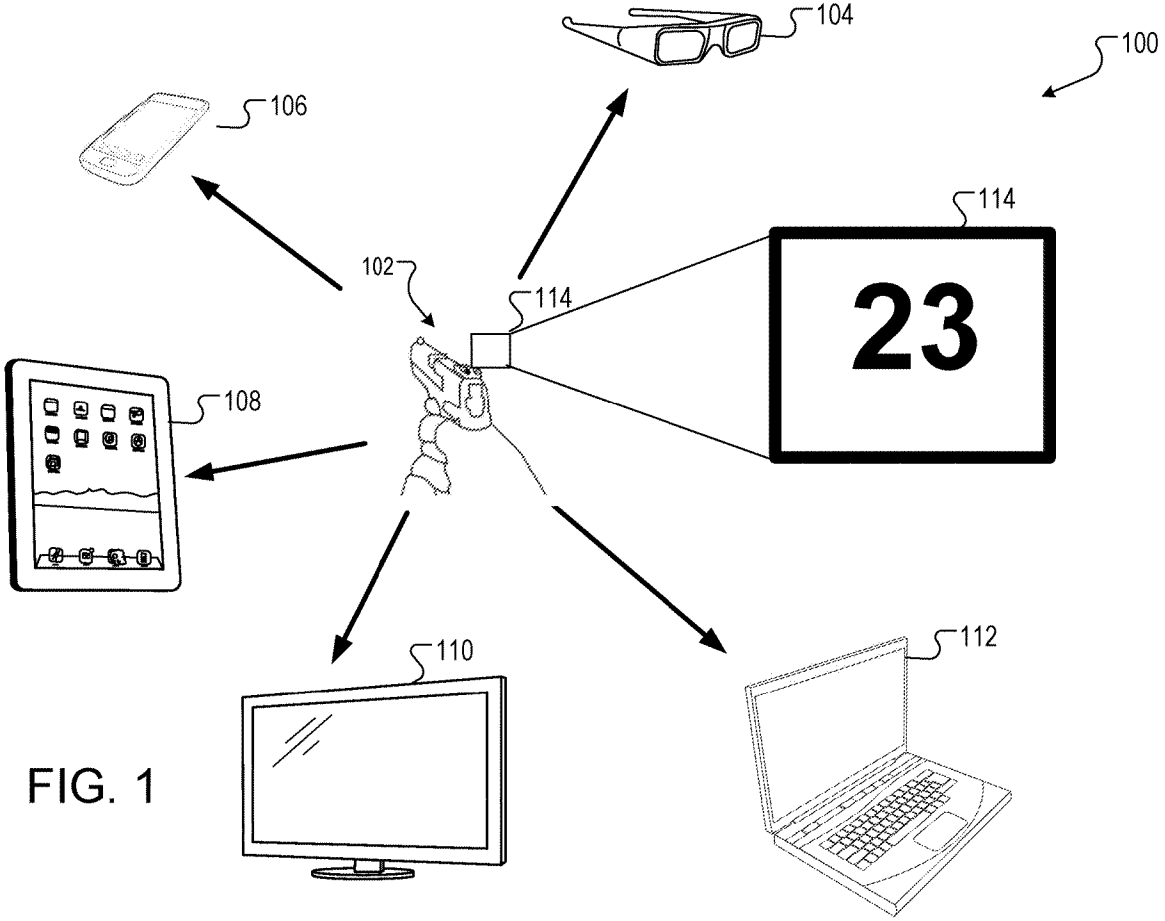
FIG. 1 is a system drawing showing the weapons system smart device in communication with various display devices.

Referring to FIG. 1, a collection 100 of potential systems, platforms, devices, etc. is illustrated that may interact with the weapons system smart device 102. For example, the weapons system smart device 102 includes a display or screen 114 to show content (e.g., firing count displayed as a graphic, text, etc.) that can be seen by the user holding the weapon or overseer of the weapon. That content may be communicated with and displayed on various devices including wearable devices such as glasses 104 (or one or more similar devices). Hand-held devices such as a cellular telephone 106, a tablet computing device 108, a smart device, etc. may receive and display the data. Similarly, a television 110 or different types of computing devices (e.g., a laptop computer system 112) may also receive and display the data. Screen 114 and the various devices may also display warnings, for example, warning that the weapons firing count has reached a predetermined threshold or that the weapon system is facing an undesired or dangerous direction with respect to other friendly objects. These friendly objects would send out information to each other on a network and share their location. These warnings and the display can either be offboard the weapon (e.g., on a cell phone 106 or tablet 108) or integrated in the firearm (e.g., displayed when the user looks through the weapon's scope).

Figure 2:
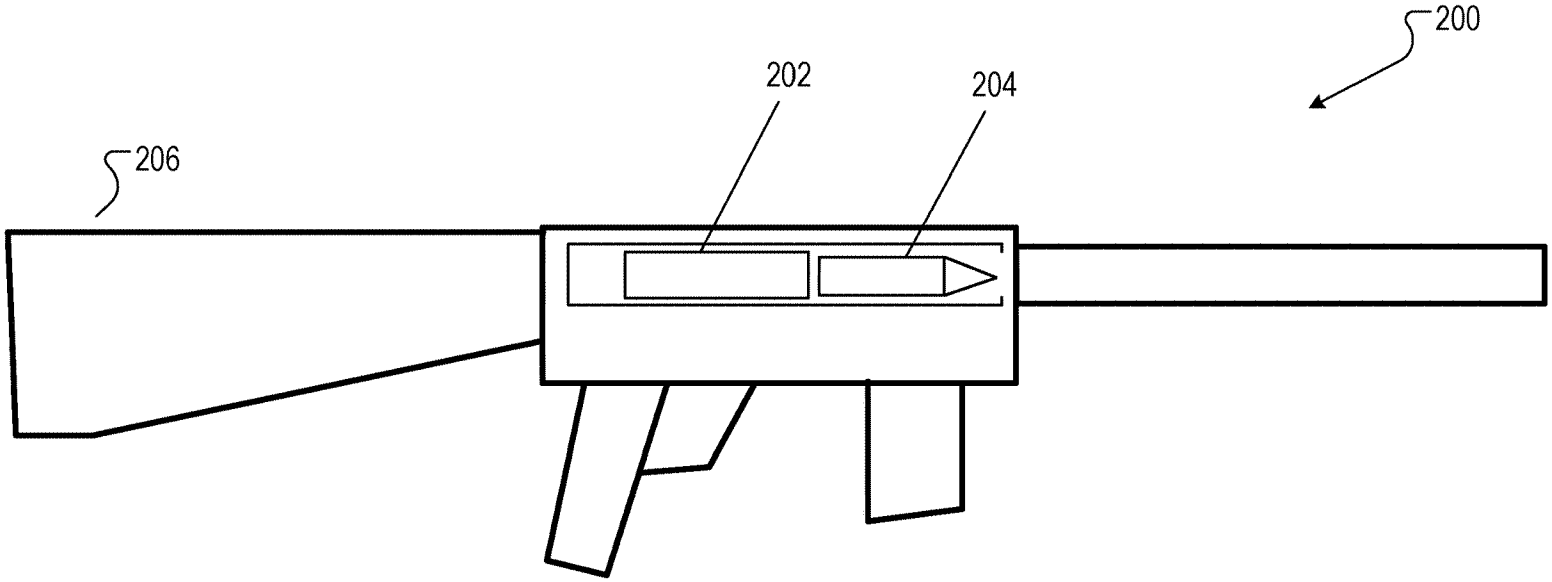
FIG. 2 shows an exemplary rifle type weapon system with the weapons system smart device.

FIG. 2 shows a weapons system smart device 200 being deployed in a rifle based weapon system. The primary components of the rifle relevant to the use of the weapons system smart device are the bolt carrier group 202 and bullet/shell casing combination 204 in the firearm 206.

Figure 3:
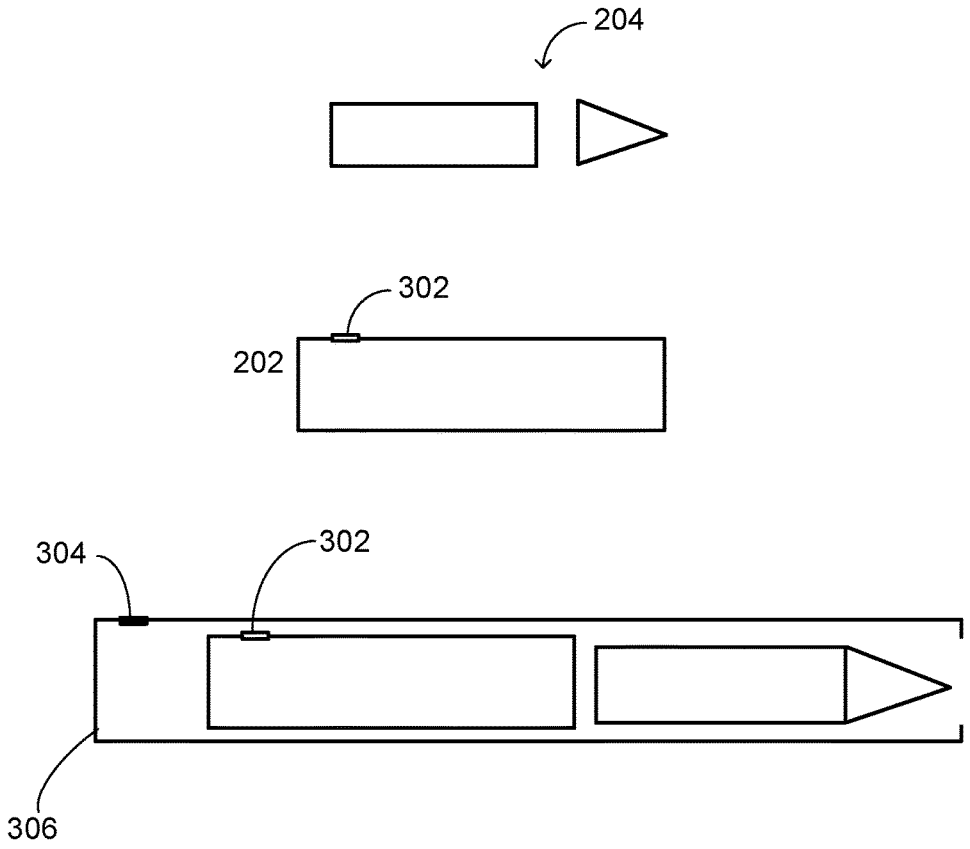
FIG. 3 is a close-in view of the mechanical components of the weapons system smart device.

FIG. 3 gives us a closer look at the mechanics of one embodiment of the system 100. The weapons system smart device employs the use of a magnetic field that is created by an electric current or permanent magnet 302. In the examples shown in the figures, the magnet 302 is located on the bolt carrier group 202 which is a moving part within a firing chamber 306. A Hall effect sensor or reed switch 304 mounted on the firing chamber 306 detects the presence of this magnet 302 when it passes or is in proximity to the sensor 304. In FIG. 3 a magnet is shown placed on the bolt carrier group 202 of the firearm 206 while the sensor 304 is located on the exterior portion of the firearm 206 directly opposite the wall of the magnet, which is stationary relative to the action of the firearm 206. In other embodiments, the magnet and sensor positions could be switched or positions changed or used on any moving part in various weapon systems such that the sensor is on an interior or exterior portion of a firearm or weapon system and configured to detect the motion of a moving part of the firearm relative to the sensor. Multiple magnets and sensors can be used for redundancy. In FIG. 3, the magnet 302 and sensor 304 system are not shown in line when the firearm is in the rest position but the positions can be changed.

Figure 4:
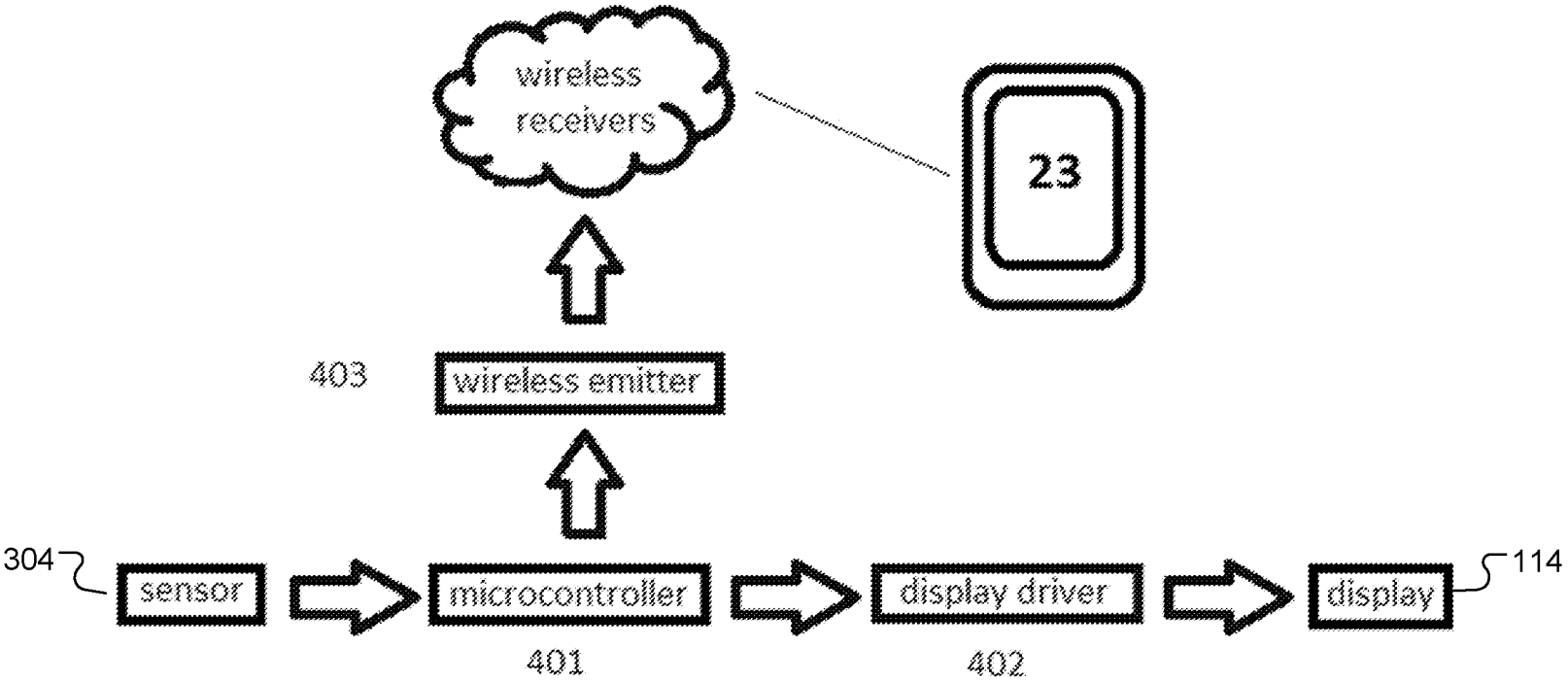
FIG. 4 depicts the communications components of interest of the weapons system smart device.

Referring to FIG. 4, a change in voltage caused by a signal of the sensor 304 due to the passage of the magnet 302 is then converted by an analog to digital converter that can be interpreted by an integrated circuit as a high or low signal. The CPU in microcontroller 401 increases the value of a variable that represents the number of times the weapon has cycled. This value can then be read by devices that interface with the microcontroller 401 such as a display driver 402 that displays the information on the screen 114 to be seen by the user. Alternatively the microcontroller 401 can send the information to a wireless module 403 that broadcasts information to another electronic device such as the devices shown in FIG. 1, which can be located remotely, such as at a base defense operations center. To conserve power, the CPU can enter a low power state until the next cycling event.

Figure 5A:
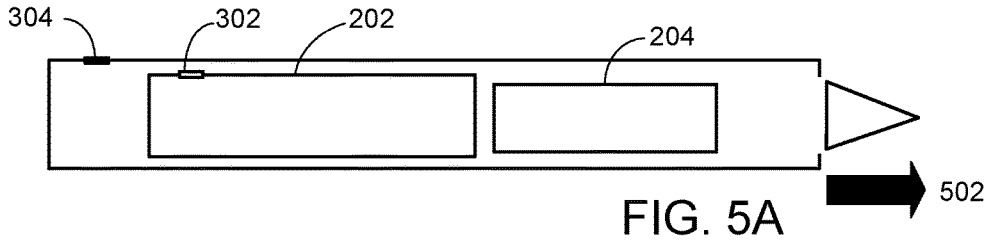
FIGS. 5A-D shows the action of the exemplary rifle as a bullet is fired.
Figure 5B:
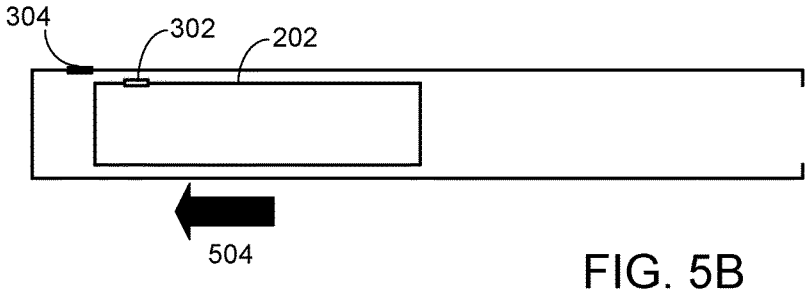
Figure 5C:
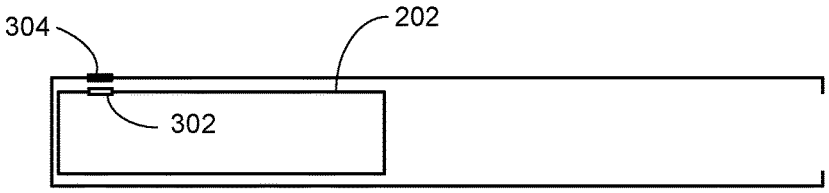
Figure 5D:
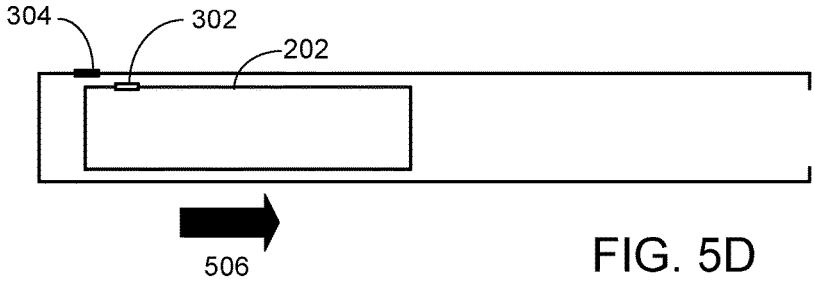

The action of a bullet being fired and leaving the firearm 206 to trigger the weapons system smart device 102 is shown in FIGS. 5A-D. In FIG. 5A, the bullet/casing combination 204 is projected outwards in the direction of arrow 502 and the gases expelled from the detonation of the gunpowder cause the bolt carrier group 202 to move backwards towards the rear of the firearm 206 as shown by arrow 504, FIG. 5B and FIG. 5C, causing the magnet 302 and sensor 304 to come into proximity. As the magnet 302 and sensor 304 pass each other, data from the movement such as shot count registers and is displayed (on e.g., any of the displays shown in FIG. 1). The bolt carrier temporarily comes to rest. FIG. 5D shows the bolt carrier group 202 returning to its "rest" position in direction shown by arrow 506. The return completes the registering of the diagnostic data.

Figure 6:
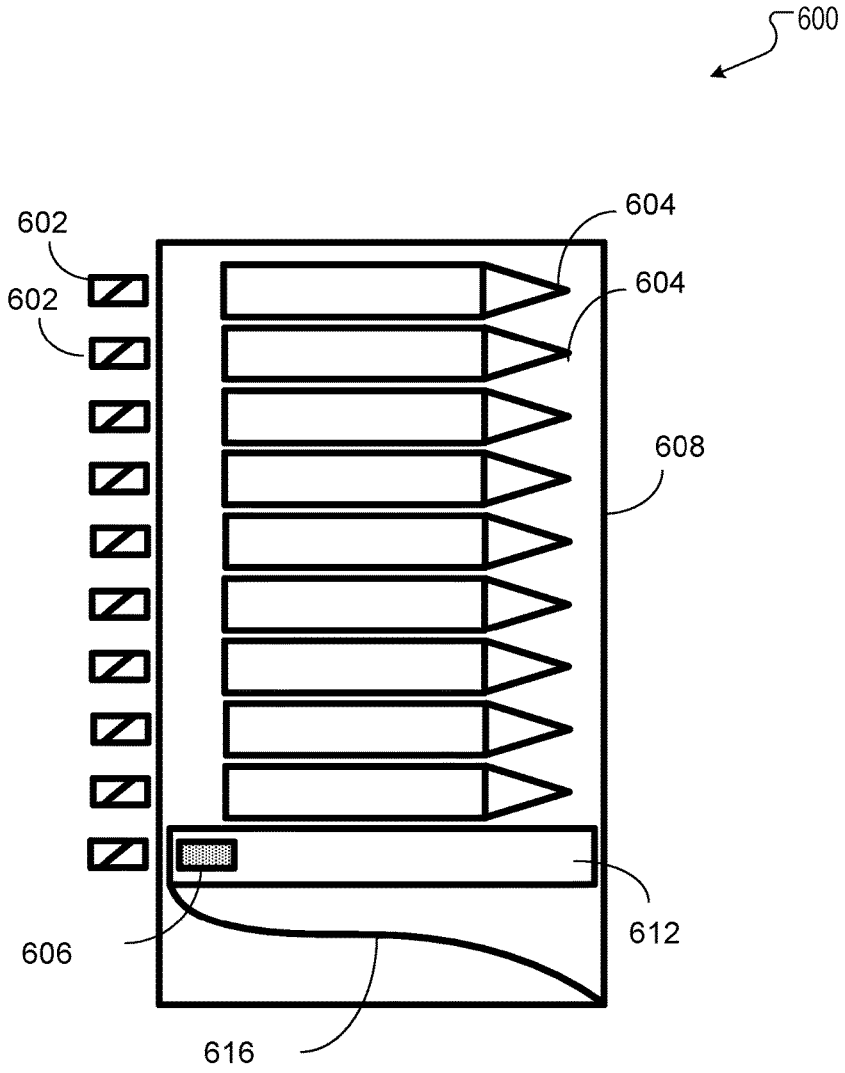
FIG. 6 is a magazine outfitted with sensors.

In some embodiments, a smart magazine 600, example in FIG. 6, can be employed with the weapons system smart device to give the user a known correct ammunition count. Multiple casings/bullets 606 are located within a magazine 608. A follower 612 is attached to a spring 616 that presses against the casings/bullets 606 in the magazine 608. As the follower 612 pushes against the casings/bullets 606 it moves upwards and downwards in the magazine 608 as bullets 606 are added or discharged. A magnet 606 on the follower 612 aligns with one of the sensors 602 attached to the magazine 608 depending on the number of bullets 606 in the magazine 608. There are multiple sensors 602 on the magazine 608 which individually detect the location of the follower 612 sits depending on the number of bullets 606 in the magazine 608. Alternatively, multiple magnets 606 can be mounted on the magazine 608 and a single sensor 602 mounted on the follower 612. In either configuration, the sensor 602 that detects the presence of the magnet 606 communicates to the smart device the new location of the follower 612. This eliminates user error as the magazine 608 will tell the microcontroller 401 how many rounds are in the magazine 608 instead of the user having to have the weapons system smart device 102 count from 0-DONE and remember how many rounds were in the magazine at the start. The microcontroller 401 would tell the user there were, e.g., 30 rounds in the magazine and display such information. The display and information would be customized to each magazine, e.g. how many rounds are in each magazine.

In the figures, the magnet is located on a moving part of the firearm or magazine, but the positions of the magnets and sensors could be reversed with same operation results. Multiple magnets and sensors can be used for redundancy to ensure correct output and functionality of the disclosure.

In any embodiment, a global position system and/or inertial navigation system can be attached to the weapon system. An INS is a navigation aid that includes motion sensors such as accelerometers and rotation sensors such as gyroscopes to continuously calculate the position, orientation, and velocity (including the direction and magnitude/speed) of a moving object without the need for external references. Such accelerometers and gyroscopes can be positioned on the weapon system 100. The INS can be used with, or instead of the GPS such as in the event the global positioning system is unavailable.

Is one embodiment, multiple weapons including weapons system 100 can deployed. Each firearm 206 can include a GPS and/or INS. The microcontroller 401 for each firearm 206 can communicate the location, position, heading, and/or attitude of each weapon 206 to each other weapon 206 in the system. If a microcontroller 401 detects that its respective firearm 206 is pointed in an undesired direction, e.g., towards another firearm 206 and presumably a friendly user, a warning message can be displayed on display 114. In some embodiments, the location, position, heading, and/or attitude information can integrate with other external information such as a map stored in a memory. The warning shown in display 114 can indicate that the weapon is pointed in a known undesired direction, e.g., towards a gas tank or other flammable or explosive item, or towards a building.

Figure 7A:
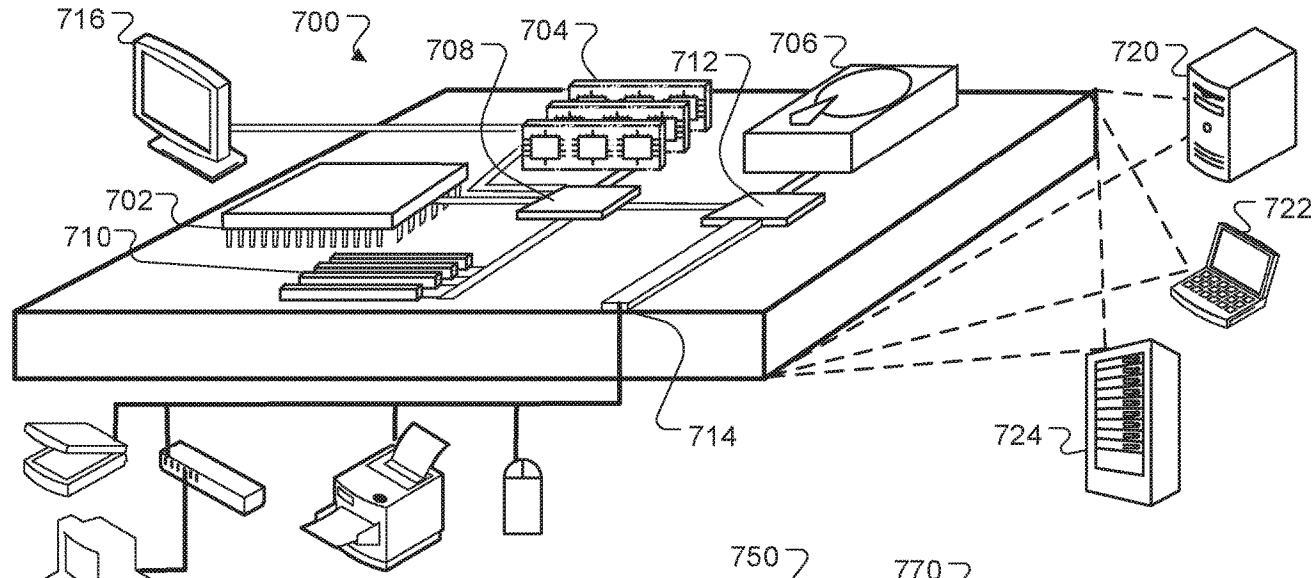
FIGS. 7A and B illustrate examples of a computing device and a mobile computing device that can be used to implement the techniques described here.
Figure 7B:
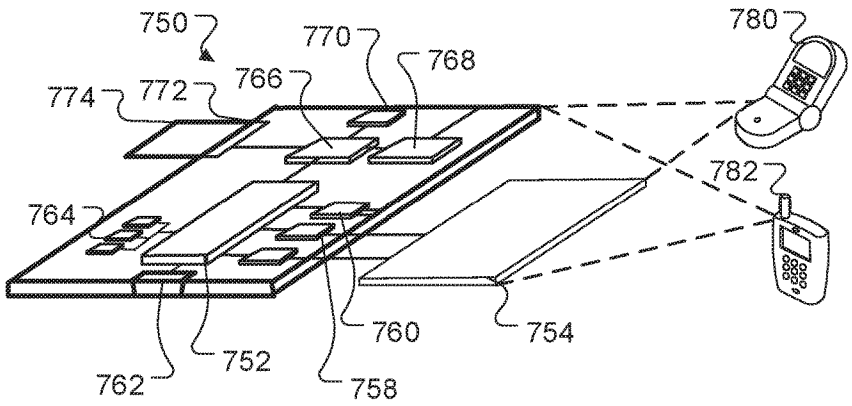

FIG. 7A shows an example of example computer device 700 and FIG. 7B shows an example mobile computer device 750, either of which can be used to process weapon related information and implement the techniques described herein. Computing device 700 is intended to represent various forms of digital computers, including, e.g., laptops, desktops, workstations, personal digital assistants, servers, blade servers, mainframes, and other appropriate computers. Computing device 750 is intended to represent various forms of mobile devices, including, e.g., personal digital assistants, cellular telephones, smartphones, and other similar computing devices. The components shown here, their connections and relationships, and their functions, are meant to be examples only, and are not meant to limit implementations of the techniques described and/or claimed in this document.

Computing device 700 includes processor 702, memory 704, storage device 706, high-speed interface 708 connecting to memory 704 and high-speed expansion ports 710, and low speed interface 712 connecting to low speed bus 714 and storage device 706. Each of components 702, 704, 706, 708, 710, and 712, are interconnected using various busses, and can be mounted on a common motherboard or in other manners as appropriate. Processor 702 can process instructions for execution within computing device 700, including instructions stored in memory 704 or on storage device 706 to display graphical data for a GUI on an external input/output device, including, e.g., display 716 coupled to high speed interface 708. In other implementations, multiple processors and/or multiple buses can be used, as appropriate, along with multiple memories and types of memory. Also, multiple computing devices 700 can be connected, with each device providing portions of the necessary operations (e.g., as a server bank, a group of blade servers, or a multiprocessor system).

Memory 704 stores data within computing device 700. In one implementation, memory 704 is a volatile memory unit or units. In another implementation, memory 704 is a non-volatile memory unit or units. Memory 704 also can be another form of computer-readable medium, including, e.g., a magnetic or optical disk. Memory 704 may be non-transitory.

Storage device 706 is capable of providing mass storage for computing device 700. In one implementation, storage device 706 can be or contain a computer-readable medium, including, e.g., a floppy disk device, a hard disk device, an optical disk device, or a tape device, a flash memory or other similar solid state memory device, or an array of devices, including devices in a storage area network or other configurations. A computer program product can be tangibly embodied in a data carrier. The computer program product also can contain instructions that, when executed, perform one or more methods, including, e.g., those described above. The data carrier is a computer- or machine-readable medium, including, e.g., memory 704, storage device 706, memory on processor 702, and the like.

High-speed controller 708 manages bandwidth-intensive operations for computing device 700, while low speed controller 712 manages lower bandwidth-intensive operations. Such allocation of functions is an example only. In one implementation, high-speed controller 708 is coupled to memory 704, display 716 (e.g., through a graphics processor or accelerator), and to high-speed expansion ports 710, which can accept various expansion cards (not shown). In the implementation, low-speed controller 712 is coupled to storage device 706 and low-speed expansion port 714. The low-speed expansion port, which can include various communication ports (e.g., USB, Bluetooth®, Ethernet, wireless Ethernet), can be coupled to one or more input/output devices, including, e.g., a keyboard, a pointing device, a scanner, or a networking device including, e.g., a switch or router, e.g., through a network adapter.

Computing device 700 can be implemented in a number of different forms, as shown in the figure. For example, it can be implemented as standard server 720, or multiple times in a group of such servers. It also can be implemented as part of rack server system 724. In addition or as an alternative, it can be implemented in a personal computer including, e.g., laptop computer 722. In some examples, components from computing device 700 can be combined with other components in a mobile device (not shown), including, e.g., device 750. Each of such devices can contain one or more of computing device 700, 750, and an entire system can be made up of multiple computing devices 700, 750 communicating with each other.

Computing device 750 includes processor 752, memory 764, an input/output device including, e.g., display 754, communication interface 766, and transceiver 768, among other components. Device 750 also can be provided with a storage device, including, e.g., a microdrive or other device, to provide additional storage. Each of components 750, 752, 764, 754, 766, and 768, are interconnected using various buses, and several of the components can be mounted on a common motherboard or in other manners as appropriate.

Processor 752 can execute instructions within computing device 750, including instructions stored in memory 764. The processor can be implemented as a chipset of chips that include separate and multiple analog and digital processors. The processor can provide, for example, for coordination of the other components of device 750, including, e.g., control of user interfaces, applications run by device 750, and wireless communication by device 750.

Processor 752 can communicate with a user through control interface 758 and display interface 656 coupled to display 754. Display 754 can be, for example, a TFT LCD (Thin-Film-Transistor Liquid Crystal Display) or an OLED (Organic Light Emitting Diode) display, or other appropriate display technology. Display interface 656 can comprise appropriate circuitry for driving display 754 to present graphical and other data to a user. Control interface 758 can receive commands from a user and convert them for submission to processor 752. In addition, external interface 762 can communicate with processor 642, so as to enable near area communication of device 750 with other devices. External interface 762 can provide, for example, for wired communication in some implementations, or for wireless communication in other implementations, and multiple interfaces also can be used.

Memory 764 stores data within computing device 750. Memory 764 can be implemented as one or more of a computer-readable medium or media, a volatile memory unit or units, or a non-volatile memory unit or units. Expansion memory 774 also can be provided and connected to device 750 through expansion interface 772, which can include, for example, a SIMM (Single In Line Memory Module) card interface. Such expansion memory 774 can provide extra storage space for device 750, or also can store applications or other data for device 750. Specifically, expansion memory 774 can include instructions to carry out or supplement the processes described above, and can include secure data also. Thus, for example, expansion memory 774 can be provided as a security module for device 750, and can be programmed with instructions that permit secure use of device 750. In addition, secure applications can be provided through the SIMM cards, along with additional data, including, e.g., placing identifying data on the SIMM card in a non-hackable manner.

The memory can include, for example, flash memory and/or NVRAM memory, as discussed below. In one implementation, a computer program product is tangibly embodied in a data carrier. The computer program product contains instructions that, when executed, perform one or more methods, including, e.g., those described above. The data carrier is a computer- or machine-readable medium, including, e.g., memory 764, expansion memory 774, and/or memory on processor 752, which can be received, for example, over transceiver 768 or external interface 762.

Device 750 can communicate wirelessly through communication interface 766, which can include digital signal processing circuitry where necessary. Communication interface 766 can provide for communications under various modes or protocols, including, e.g., GSM voice calls, SMS, EMS, or MMS messaging, CDMA, TDMA, PDC, WCDMA, CDMA2000, or GPRS, among others. Such communication can occur, for example, through radio-frequency transceiver 768. In addition, short-range communication can occur, including, e.g., using a Bluetooth®, WiFi, or other such transceiver (not shown). In addition, GPS (Global Positioning System) receiver module 670 can provide additional navigation- and location-related wireless data to device 750, which can be used as appropriate by applications running on device 750. Sensors and modules such as cameras, microphones, compasses, accelerators (for orientation sensing), etc. maybe included in the device.

Device 750 also can communicate audibly using audio codec 760, which can receive spoken data from a user and convert it to usable digital data. Audio codec 760 can likewise generate audible sound for a user, including, e.g., through a speaker, e.g., in a handset of device 750. Such sound can include sound from voice telephone calls, can include recorded sound (e.g., voice messages, music files, and the like) and also can include sound generated by applications operating on device 750.

Computing device 750 can be implemented in a number of different forms, as shown in the figure. For example, it can be implemented as cellular telephone 780. It also can be implemented as part of smartphone 782, personal digital assistant, or other similar mobile device.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which can be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms machine-readable medium and computer-readable medium refer to a computer program product, apparatus and/or device (e.g., magnetic discs, optical disks, memory, Programmable Logic Devices (PLDs)) used to provide machine instructions and/or data to a programmable processor, including a machine-readable medium that receives machine instructions.

To provide for interaction with a user, the systems and techniques described here can be implemented on a computer having a display device (e.g., a CRT (cathode ray tube) or LCD (liquid crystal display) monitor) for displaying data to the user and a keyboard and a pointing device (e.g., a mouse or a trackball) by which the user can provide input to the computer. Other kinds of devices can be used to provide for interaction with a user as well; for example, feedback provided to the user can be a form of sensory feedback (e.g., visual feedback, auditory feedback, or tactile feedback); and input from the user can be received in a form, including acoustic, speech, or tactile input.

The systems and techniques described here can be implemented in a computing system that includes a back end component (e.g., as a data server), or that includes a middleware component (e.g., an application server), or that includes a front end component (e.g., a client computer having a user interface or a Web browser through which a user can interact with an implementation of the systems and techniques described here), or a combination of such back end, middleware, or front end components. The components of the system can be interconnected by a form or medium of digital data communication (e.g., a communication network). Examples of communication networks include a local area network (LAN), a wide area network (WAN), and the Internet.

The computing system can include clients and servers. A client and server are generally remote from each other and typically interact through a communication network. The relationship of client and server arises by virtue of computer programs running on the respective computers and having a client-server relationship to each other.

In some implementations, the engines described herein can be separated, combined or incorporated into a single or combined engine. The engines depicted in the figures are not intended to limit the systems described here to the software architectures shown in the figures.

A number of embodiments of the invention have been described. Nevertheless, it will be understood that various modifications may be made without departing from the spirit and scope of the invention. For example, in the figures a rifle type weapon system with magnet and sensor located on and near the bolt carrier group is shown but the magnet and sensor system can be used in various positions on various weapons systems. Accordingly, other embodiments are within the scope of the following claims.

What is claimed is:

1. A weapons system, comprising:

a firearm;

one or more sensors on an interior or an exterior portion of the firearm configured to detect a motion or a location of a moving part of the firearm relative to the one or more sensors, wherein the one or more sensors includes a reed switch;

at least one heading and location sensor configured to detect a heading and a location of the firearm;

a microprocessor configured to:

receive a signal sent by the one or more sensors and determine a status of the firearm from the received signal and to increment a counter representing a number of instances the firearm has been discharged, and receive a second signal sent by the at least one heading and location sensor and determine when the heading and the location of the firearm corresponds with known undesired locations; and a display in communication with the microprocessor configured to display information relating to the status of the firearm and a warning when the firearm is pointed in a known undesired direction, and wherein the firearm is configured to provide power to components attached to the firearm.

2. The weapons system of claim 1, wherein the one or more sensors includes a Hall Effect sensor.

3. The weapons system of claim 1, wherein the moving part of the firearm is a bolt carrier, and the microprocessor determines that the signal sent from the one or more sensors represents a discharging of an ammunition round and a shell casing from the firearm.

4. The weapons system of claim 1, wherein the moving part of the firearm is a follower that moves in a magazine of the firearm as ammunition rounds are added to or removed from the magazine, the one or more sensors are coupled to the magazine and detect a position of the follower.

5. The weapons system of claim 4, wherein at least one of the one or more sensors comprises multiple portions coupled to the magazine and a single portion coupled to the follower that aligns with one of the multiple portions coupled to the magazine.

6. The weapons system of claim 4, wherein the microprocessor receives the signal sent by the one or more sensors indicating the position of the follower within the magazine and determines a number of the ammunition rounds present in the magazine.

7. The weapons system of claim 1, wherein the microprocessor is configured to determine a number of ammunition rounds remaining in a magazine residing in the firearm.

8. The weapons system of claim 1, wherein the display is configured to show the number of instances the firearm has been discharged.

9. The weapons system of claim 1, wherein the display is configured to present the location and the heading of the firearm.

10. The weapons system of claim 1, wherein the display is part of a smart phone or tablet located external to the firearm.

11. The weapons system of claim 1, wherein the display is attachable to the firearm.

12. The weapons system of claim 1, wherein the moving part of the firearm is a bolt carrier group.

13. The weapons system of claim 1, further comprising a magnet located on the moving part of the firearm that triggers the one or more sensors when the magnet and the one or more sensors are in proximity to one another.

14. The weapons system of claim 1, wherein the firearm is configured to provide the power by an electromagnetic field.

15. The weapons system of claim 1, further comprising one or more biological sensors.

16. The weapons system of claim 15, wherein the one or more biological sensors include a heart or a pulse monitor.

17. The weapons system of claim 1, wherein the one or more sensors comprises a Hall Effect sensor mounted on a firing chamber of the firearm that is configured to detect the presence of a magnet located on a bolt carrier group of the firearm when the Hall Effect sensor and the magnet are in proximity to one another.

18. The weapons system of claim 1, wherein the moving part of the firearm is a follower with a magnet mounted thereon that moves in a magazine of the firearm as ammunition rounds are added to or removed from the magazine.

* * * * *